US006866159B2

(12) United States Patent
Yamane

(10) Patent No.: US 6,866,159 B2
(45) Date of Patent: Mar. 15, 2005

(54) TUBULAR SHAPED CASE

(75) Inventor: Yusaku Yamane, Kobe (JP)

(73) Assignee: Felissimo Corporation, Hyogo (JP)

( * ) Notice: Subject to any disclaimer, the term of this patent is extended or adjusted under 35 U.S.C. 154(b) by 52 days.

(21) Appl. No.: 10/340,639

(22) Filed: Jan. 13, 2003

(65) Prior Publication Data

US 2003/0102319 A1 Jun. 5, 2003

Related U.S. Application Data

(63) Continuation of application No. PCT/JP01/00169, filed on Jan. 12, 2001.

(30) Foreign Application Priority Data

Nov. 7, 2000 (JP) ..... 2000-339568
Nov. 15, 2000 (JP) ..... 2000-348574

(51) Int. Cl.[7] ..... B65D 25/20; B65D 81/18

(52) U.S. Cl. ..... 215/400; 215/11.6; 215/12.1; 215/395; 215/399; 150/901; 220/737; 220/739; 220/890; 220/903; 224/148.6

(58) Field of Search ..... 215/11.6, 12.1, 215/395, 399, 400; 150/901, 154; 220/739, 903; 224/148.6, 592.17, 737, 890

(56) References Cited

U.S. PATENT DOCUMENTS

| | | | | | |
|---|---|---|---|---|---|
| 485,098 | A | * | 10/1892 | Forshew | 215/12.1 |
| 1,210,892 | A | * | 1/1917 | Borchmann | 215/12.1 |
| 2,161,935 | A | * | 6/1939 | Roberts | 215/12.1 |
| 2,389,390 | A | * | 11/1945 | Silverman et al. | 215/11.6 |
| 2,464,069 | A | * | 3/1949 | Benson | 206/466 |
| 2,522,381 | A | * | 9/1950 | Kramer | 215/12.1 |
| 3,085,612 | A | * | 4/1963 | Gobel | 215/11.6 |
| 4,057,854 | A | | 11/1977 | Phelps, Sr. | |
| 4,197,890 | A | * | 4/1980 | Simko | 383/97 |
| 4,401,245 | A | * | 8/1983 | Zills | 224/148.3 |
| 4,513,895 | A | | 4/1985 | Leslie | |
| 5,261,554 | A | * | 11/1993 | Forbes | 220/412 |
| D353,520 | S | * | 12/1994 | Schwartz | D7/607 |
| 5,555,746 | A | * | 9/1996 | Thompson | 62/457.4 |
| 5,680,958 | A | * | 10/1997 | Mann et al. | 220/739 |
| 6,029,847 | A | * | 2/2000 | Mahoney et al. | 220/739 |
| 6,073,796 | A | * | 6/2000 | Mogil | 220/592.17 |
| 6,550,271 | B2 | * | 4/2003 | Silbert | 62/457.4 |

FOREIGN PATENT DOCUMENTS

| | | |
|---|---|---|
| FR | 2 673 083 | 8/1992 |
| GB | 1418397 | * 12/1975 |
| JP | HI-170130 | 12/1989 |
| JP | 3067195 | 12/1999 |

OTHER PUBLICATIONS

European Search Report Dated Mar. 4, 2004.

* cited by examiner

*Primary Examiner*—Sue A. Weaver
(74) *Attorney, Agent, or Firm*—Nixon Peabody LLP; Donald R. Studebaker

(57) ABSTRACT

The left arm 5 is provided on a side face adjacent to the opening 23 of the body part 3. The left arm 5 is formed of a tubular shaped cloth used for wetsuit in its diameter less than that of the body 3. Adjacent to the forefront of the left arm 5, a male piece 15 is sewn on the inside of the arm via a rubber strip 16 so as the piece to be housed in the left arm 5. Adjacent to the forefront of the right arm 7, a female piece 17 is sewn in a similar manner. A user of the holder rolls up the left arm 5 and the right arm 7 slightly so as to expose the male piece 15 and the female piece 17 therefrom, then the female piece 17 is inserted into the male piece 15 so that both pieces are in a locked-state. In this way, the PET bottle holder 1 is in a suspended state. Hence, during the unengaged state, both the male piece 15 and the female piece 17 are accommodated respectively in the left arm and the right arm.

13 Claims, 23 Drawing Sheets

TUBULAR SHAPED CASE

FIELD OF THE INVENTION

The present invention relates to a case made of a content storage tubular member. Specifically to a mechanism for suspending its own and function of blocking contact between a content storage tubular member and external environment.

BACKGROUND OF THE INVENTION

Recently, bottles made of PET (polyethylene terephthalate) are widely used for containers containing drinks such as juices so on. In order to keep a PET bottle either cold or a desired temperature, cold insulators for PET bottles are available on the market. Such insulators are formed in a tubular shape with a bottom similar to that of PET bottles. The insulator can be held with hand or can be put in a bag and the like when an inlet for the PET bottle on the insulator is closed in a form of a drawstring bag-like-state as a result of pulling the string provided to the inlet.

The inventor previously developed such a thermal insulator having a string for holding the insulator to the body part of a holder and having a member for detach that is used for dividing the insulator into two parts adjacent to a center part of string. In this way, the string can be connected when the insulator is used, on the contrary, the string can not be connected when it is unused. Consequently, the insulator can be carried in a state of suspension from a bag and the like.

The previously developed insulator, however, has the following problems to solve. At first, the members for detachment provided to the forefront of the string get in the way when the insulator is divided. Secondly, it is unsanitary with insulators, because the neck of the bottle and vicinity thereof are exposed from the holder during the use. The same problem is observed especially when a bottle is exposed outside, not housed in a bag and the like. In order to solve the second problem, the height of insulator may be increased so as to cover a part of the bottle including its neck. In such case, no problem occurs from a hygiene point of view, however, a person who drink the content of the bottle needs to take the bottle out whenever they try to drink. Similar problem is also observed not only a PET bottle, but also any other tubular shaped case into which foods/drinks are contained.

DISCLOSURE OF THE INVENTION

The object of the present invention is to provide an easy-to-carry tubular case in which engaging and holding parts do not get in the way during the unengaged state thereof. Additional object of the present invention is to provide a sanitary tubular case, which make possible to eat/drink the content stored in the bottle.

A tubular-shaped case in accordance with characteristics of the present invention, the tubular-shaped case to be used for covering a tubular member in which content is housed and a cap is provided to an exit and entry part through which the content passes through, the tubular-shaped case comprising: 1) a tubular-shaped body part having one end with a bottom so as to store the content and having the other end being opened; 2) a first arm provided to a side surface of the body adjacent to the other end thereof, the first arm formed in a tubular shape having a smaller diameter than that of the body; 3) a second arm provided opposed to the first arm so as to across the body, and the shape thereof being similar to that of the first arm; 4) a first engaging and holding part provided adjacent to an end of the first arm positioned apart from the body so that the first engaging and holding part is housed inside of the first arm; and 5) an engaging and holding part provided as a second engaging and holding part adjacent to an end of the second arm positioned apart from the body so that the first engaging and holding part is housed inside of the second arm and capable of being detached with the first engaging and holding part, wherein the second engaging and holding part is in a locked-state when the second engaging and holding part is engaged with the first engaging and holding part.

A method of suspending a PET bottle in accordance with characteristics of the present invention, the method of suspending content filled in a PET bottle while maintaining temperature of the content, comprising the steps of: storing the PET bottle in a tubular-shaped body part having one end with a bottom and having the other end being opened; providing a first arm formed in a tubular shape having a smaller diameter than that of the body to a side surface of the body adjacent to the other end thereof; setting a first engaging and holding part adjacent to an end of the arm via a member capable of being extended so that the first engaging and holding part is housed inside of the first arm; providing a second arm provided opposed to the first arm so as to across the body, and the shape thereof being similar to that of the first arm; setting an engaging and holding part adjacent to an end of the second arm via a member capable of being extended as a second engaging and holding part so that the engaging and holding part is housed inside of the second arm and capable of being detached with the first engaging and holding part, wherein the second engaging and holding part is in a locked-state when the second engaging and holding part is engaged with the first engaging and holding part; and making the PET bottle capable of being suspended by engaging the first engaging and holding part with the second engaging and holding part.

A PET bottle holder for holding a PET bottle in accordance with characteristics of the present invention, the PET bottle holder comprising: 1) a tubular-shaped body part having one end with a bottom so that the PET bottle can be stored therein and having the other end being opened; and 2) a hood part provided adjacent to the other end of the body, a string being housed around the rim of the hood part and the hood part is in a drawstring-bag state by pulling the string.

A tubular-shaped case in accordance with characteristics of the present invention, the tubular-shaped case to be used for covering a tubular member in which content is housed and a cap is provided to an exit and entry part through which the content passes through, the tubular-shaped case comprising: a tubular-shaped body part having one end with a bottom so as to store the content and having the other end being opened; and 3) a hood part that covers the exit and entry part being provided adjacent to the other end of the body.

Features, other objects, usage and advantages of the present invention will be more apparent to those skilled in the art on consideration of the accompanying drawings and following specification.

THE BEST EMBODIMENTS FOR IMPLEMENTING THE PRESENT INVENTION

Figure 1:
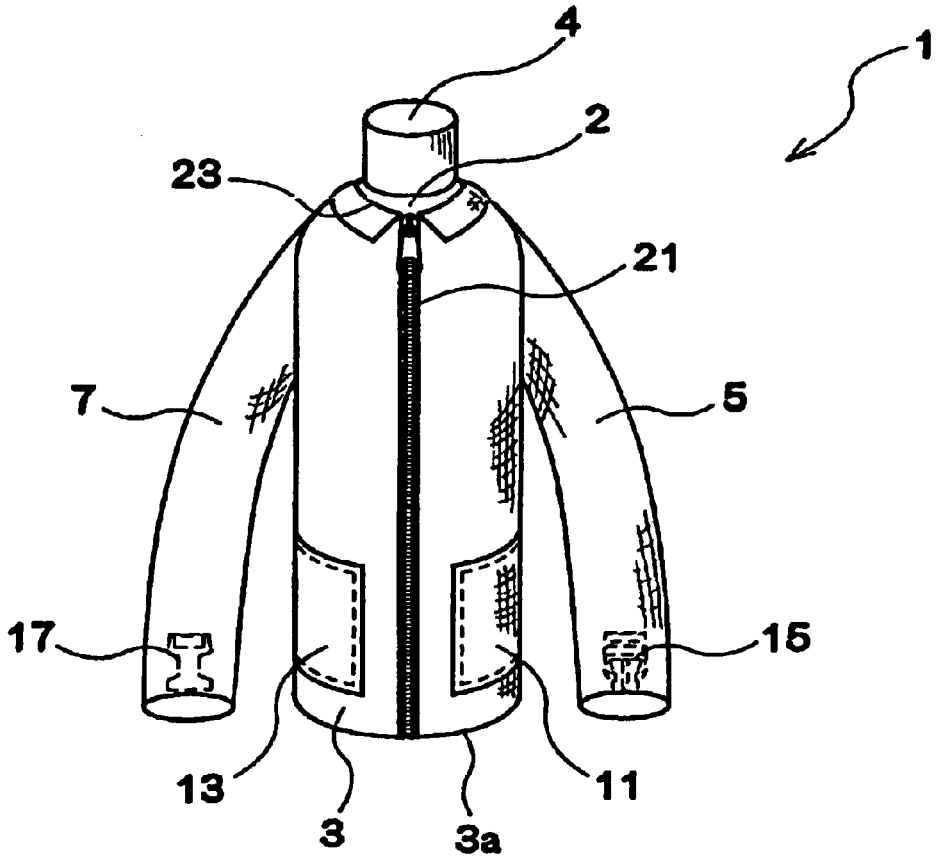
FIG. 1 shows appearance of a PET bottle holder 1 according to the present invention.

An embodiment of the present invention will be described hereunder with reference to drawings. FIG. 1 shows perspective view of a PET bottle holder 1 which houses a PET bottle 2. The PET bottle holder 1 comprises a body part 3, left arm 5, and right arm 7. The body part 3 has dual structure wherein the inside thereof is made of cold insulator forming a heat-retention member and the outside thereof is made of woolen fabric. As illustrated in FIG. 1, the bottle holder is in a tubular shape having an opening 23 through which the PET bottle 2 is inserted its inside, and has a fastener 21 on its side face. The PET bottle 2 can easily be inserted into the holder as a result of expansion of the opening 23 by unzipping the fastener 21.

Figure 2:
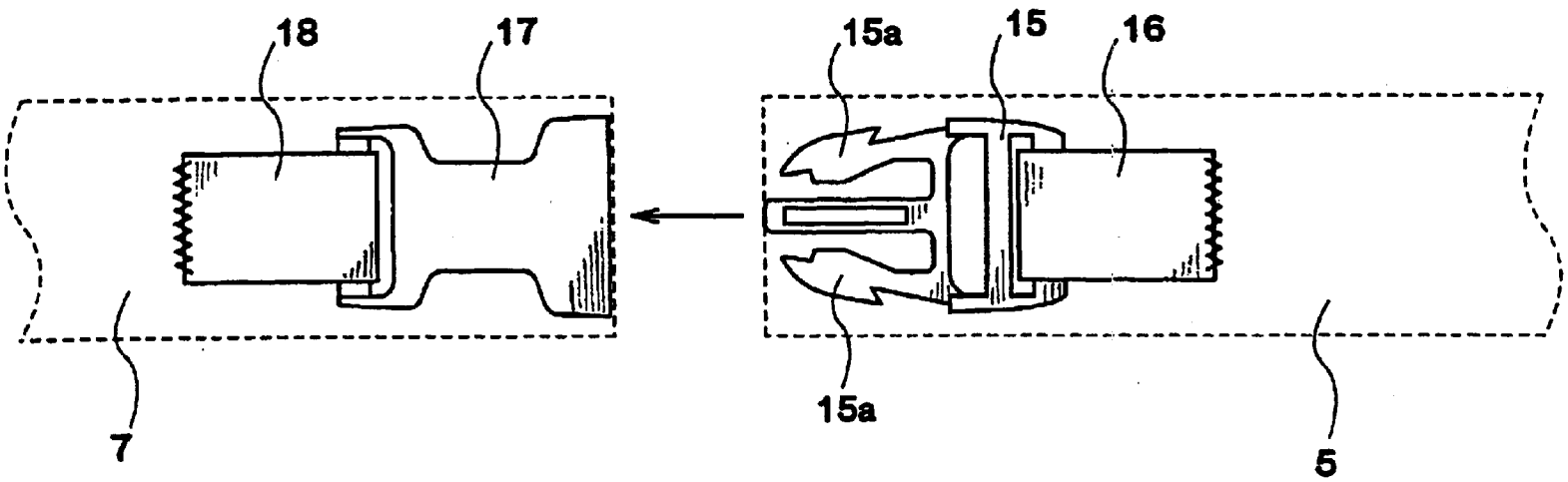
FIG. 2 is a detailed view illustrating a male piece and a female piece.

The left arm 5 is provided on a side face adjacent to the opening 23 of the body part 3. The left arm 5 is formed of a tubular shaped cloth used for wetsuit in its diameter less than that of the body 3, and its length is adjusted so that the forefront of the arm is just in contact with a surface where the bottom of the body 3 is put on. Adjacent to the forefront of the left arm 5, a male piece 15 of a side releasing buckle shown in FIG. 2 is sewn on the inside of the arm via a rubber strip 16 so as the male piece 15 to be housed in the left arm 5.

As shown in FIG. 1, the right arm 7 is provided opposed to the left arm 5 so as to across the body 3, and the shape thereof is similar to that of the left arm 5. A female piece 17 of a side releasing buckle shown in FIG. 2 is sewn adjacent to the forefront of the right arm 7 on the inside thereof via a rubber strip 18 so as to be housed in the right arm 7.

As depicted in FIG. 1, two pockets 11, 13 are provided on the sides of the body 3 so as to across the fastener 21. These packets 11, 13 are made of a cloth used for wetsuit, and both the forefronts of the left arm 5 and the right arm 7 can be accommodated therein respectively. Moreover, the pockets 11, 13 may also accommodate a cap 4 of the PET bottle 2 therein.

Figure 3:
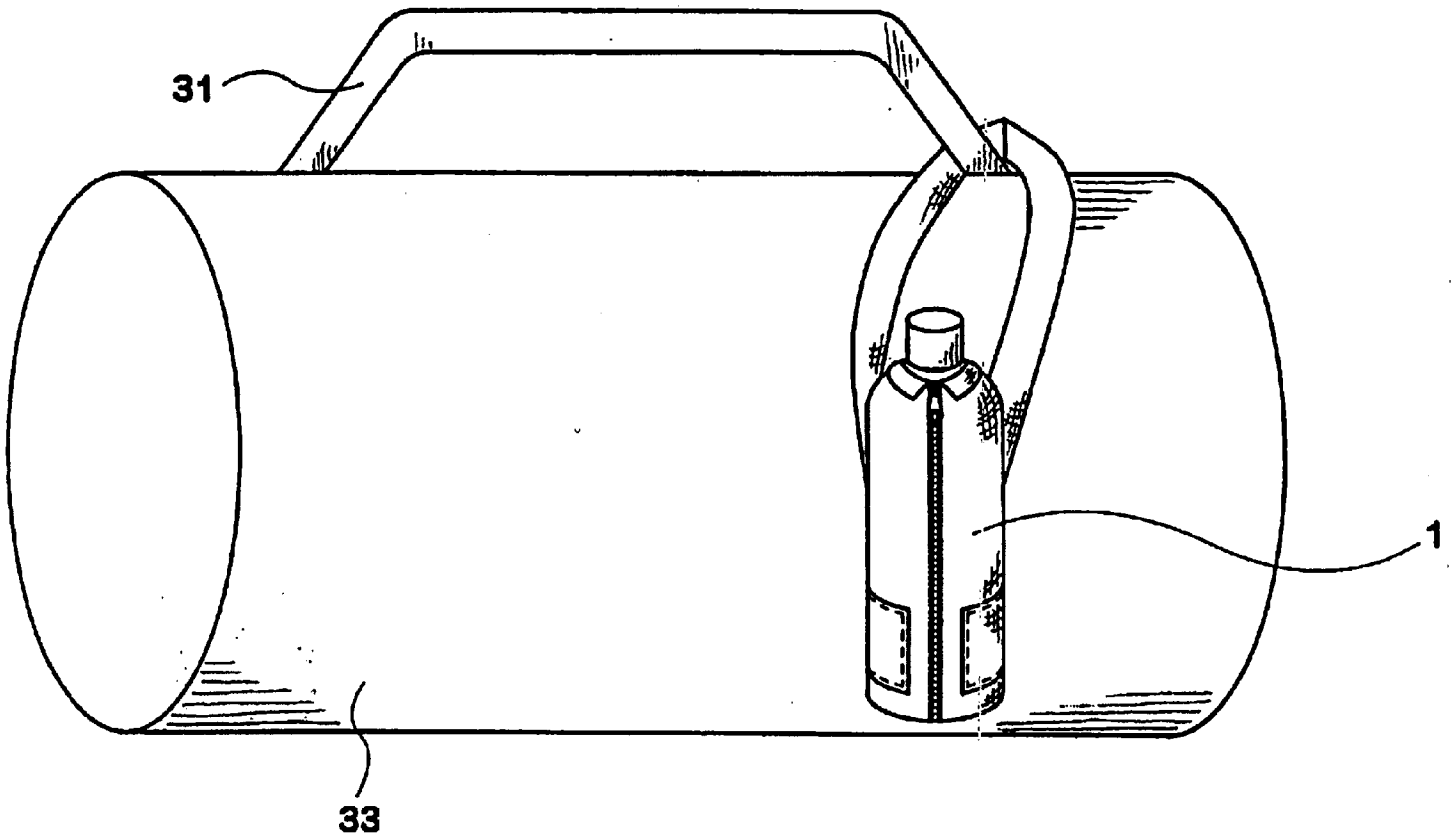
FIG. 3 shows actual use of the PET bottle holder 1 shown in FIG. 1.

With reference to FIG. 3, how to use the PET bottle holder 1 will be described. In this example, a PET bottle holder 1 is attached to a handle 31 of a bag 33. The user of the holder rolls up the left arm 5 slightly so as to expose the male piece 15 therefrom, then pass the left arm 5 under the handle 31. Then, the user rolls up the right arm 7 slightly so as to expose the female piece 17 therefrom. Thereafter, the female piece is inserted into the male piece 15 so as to be both pieces in a locked-state. In this way, the PET bottle holder 1 is in a suspended state on the handle 31. The user pinches both sides 15*a* of the male piece 15 and pulls the piece in order to release the locked-state.

Hence, both the male piece 15 and the female piece 17 are accommodated respectively in the left arm 5 and the right arm 7 via the rubber strips 16, 18. In this way, both the pieces can easily be exposed from the left arm 5 and the right arm 7 when both the pieces are engaged each other and can also easily be housed in both arms 5, 7 even after the engagement. Consequently, there is no probability to expose the male piece 15 and the female piece 17 outside of the arms during the non-engagement-state.

Figure 4:
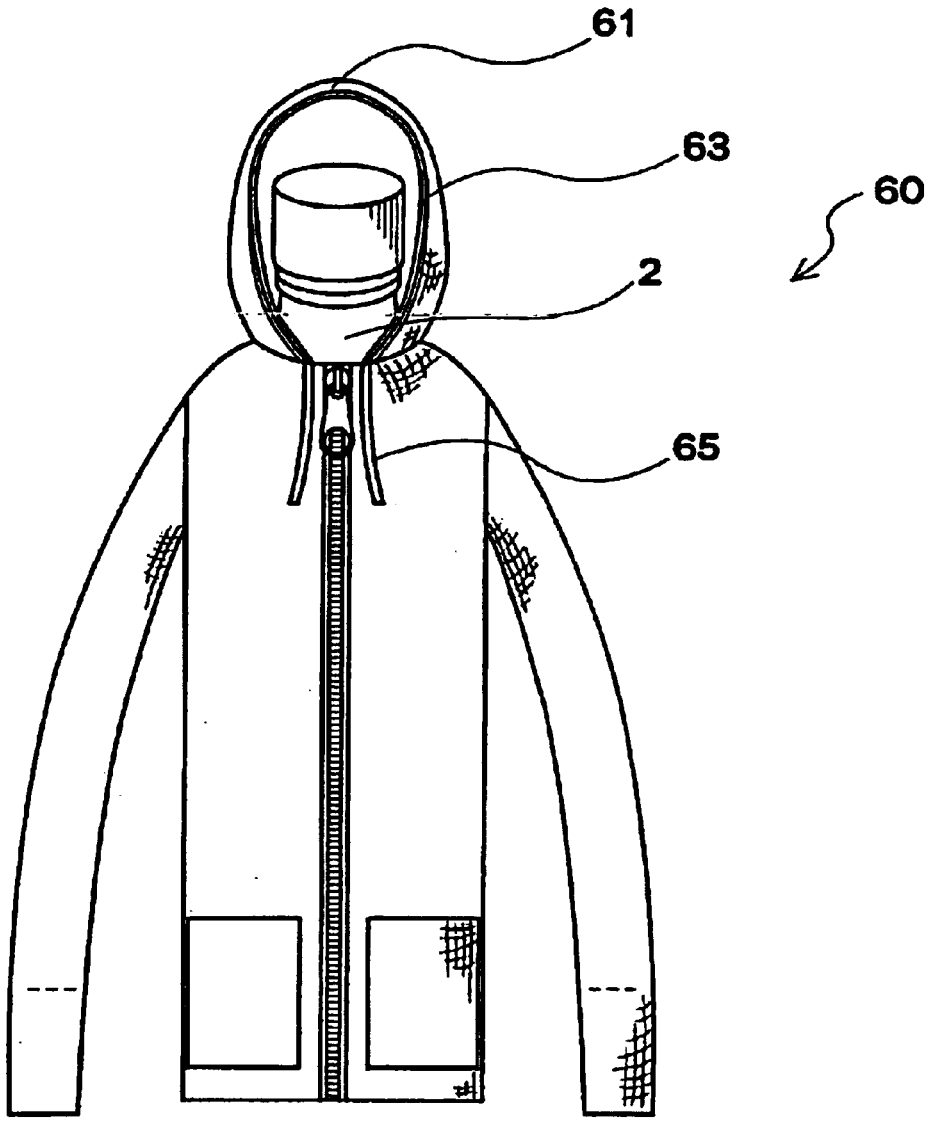
FIG. 4 shows appearance of a PET bottle holder 60 as another embodiment of the present invention.
Figure 5A:
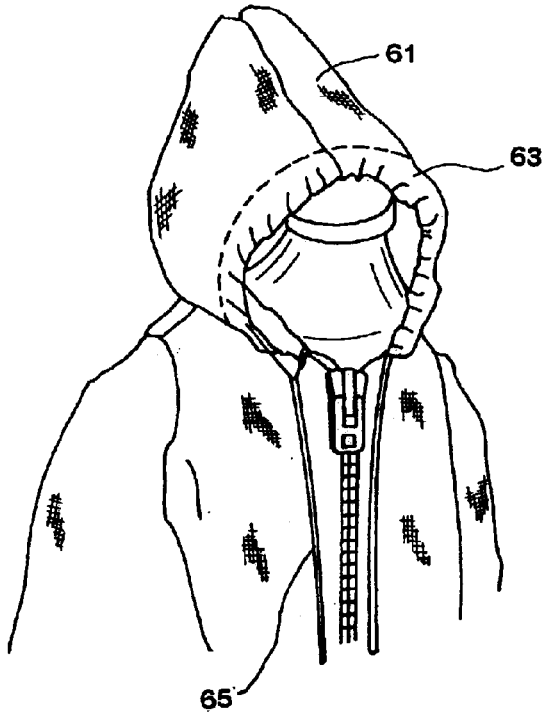
FIGS. 5A, 5B are views used for describing actual use of the PET bottle holder 60.
Figure 5B:
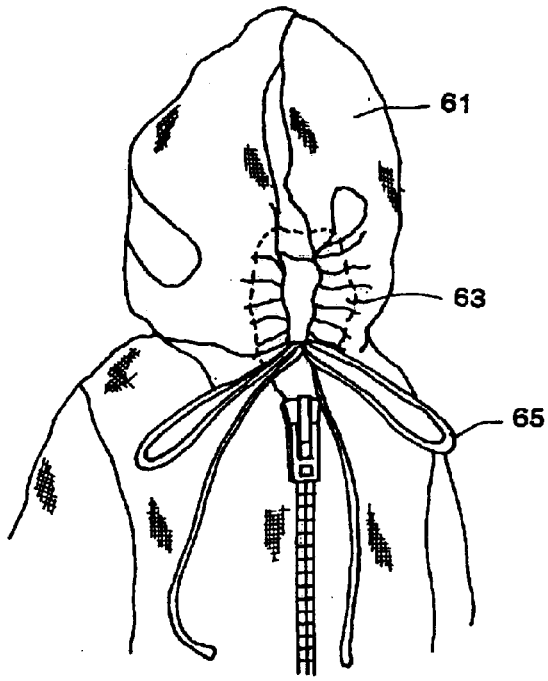

FIG. 4 shows another embodiment of the present invention. FIG. 4 shows a PET bottle holder 60 having a hood portion. The PET bottle holder 60 also has a hood 61 (the hood part) adjacent to the opening 23. A string 65 is housed around the rim 63 of the hood part 61. By pulling the string 65, the hood 61 change its shape from the one shown in FIG. 5A to the one shown in FIG. 5B in which the hood covers up the PET bottle 2. In this way, adhesion of contaminants and the like on around the tap of the bottle can be avoided even when the PET bottle holder 60 is suspended to a bag, for example. The shape of the hood shown in FIG. 5B that varies from an opened-shape to a closed-shape by pulling the string 65 housed around the rim of the hood, is referred to as the Drawstring-bag State in this specification.

Figure 6A:
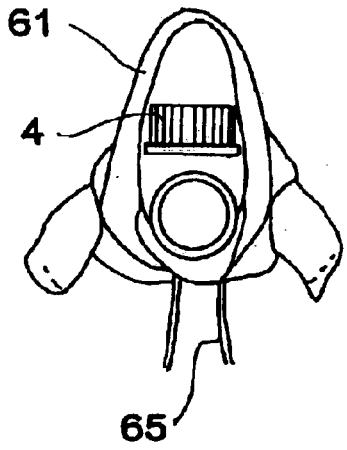
FIG. 6A is a view (overhead view) used for describing actual use of the PET bottle holder 60.
Figure 6B:
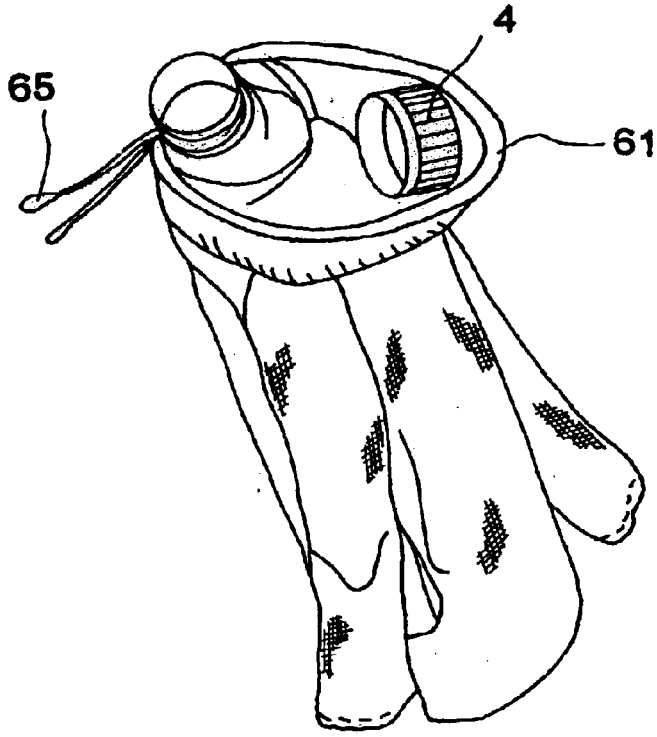
FIG. 6B is a perspective the holder.

Moreover, within the hood part 61, a cap 4 can be putted as illustrated in FIG. 6. FIG. 6A is an overhead view of the PET bottle holder, and FIG. 6B is a perspective thereof. The cap 4 can be housed within the hood so as to completely cover it by pulling the string 65 so that the hood is in the Drawstring-bag State from the state shown in the drawings.

Figure 7:
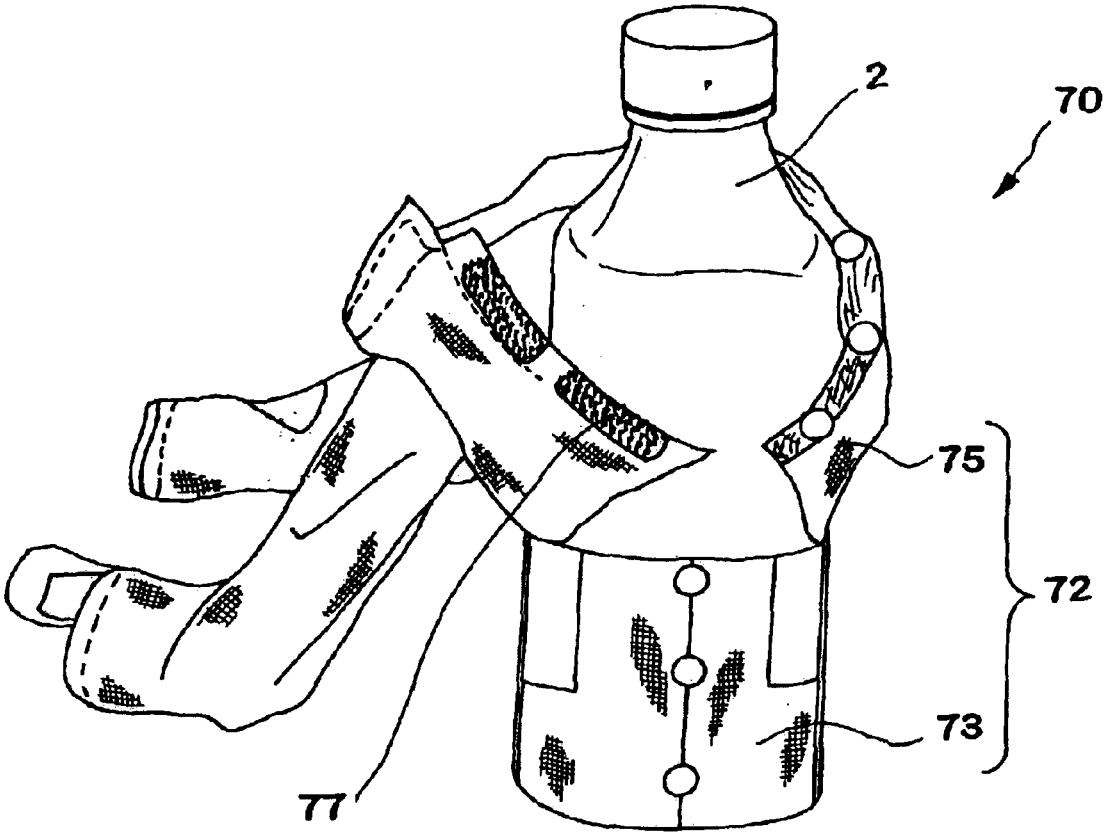
FIG. 7 shows appearance of a PET bottle holder 70 as another embodiment of the present invention.

FIG. 7 shows a PET bottle holder 70, which varies the shape of the body thereof. In the bottle holder 70, the body 72 comprises a lower body 73 and an upper body 75. The length of the lower body 73 is approximately ⅓ of the body 72. The lower body is a tubular shape, while a side of the upper body 75 is formed with a plane type fastener (fastening cloths) 77 so as to open the opening. Hence, even a user having physical handicap on their hands is easily able to house a PET bottle into a PET bottle holder by forming the body 72 with the upper body 75 capable of being opened and the lower body 73 incapable of being opened. In addition, the opening can be closed easily because the opening is closed with the plane type fastener 77.

The following advantages are expected with this embodiment. There is a type of PET bottle, which has similar diameter to the body of the ordinary ones with less height. In the first embodiment, it is hard to drink the content in the PET bottle without releasing such bottle from the PET bottle holder. On the contrary, the content in the PET bottle can be drank by just removing the upper body 75 because the PET bottle is held with the lower body 73 as a result of forming the body 70 so as to expose till the topmost of the lower bottle 73.

The proportion of the upper body and the lower body can approximately be fifty-fifty or any other ratios.

In the embodiment described in the above, a fastener 21 is provided to a side of the body 3, but the fastener 21 may be omitted. In that case, the opening may also be formed by providing a rubber string(s) so that it enlarges when a PET bottle 2 is inserted therethrough and it diminishes after the insertion of the bottle. Instead of using a rubber string(s), the size of the opening can be adjusted with a string housed around the rime of the hood and by pulling it.

The size of the opening may be adjusted using a plane type fastener, a button(s), for example, instead of the fastener 21.

Figure 8:
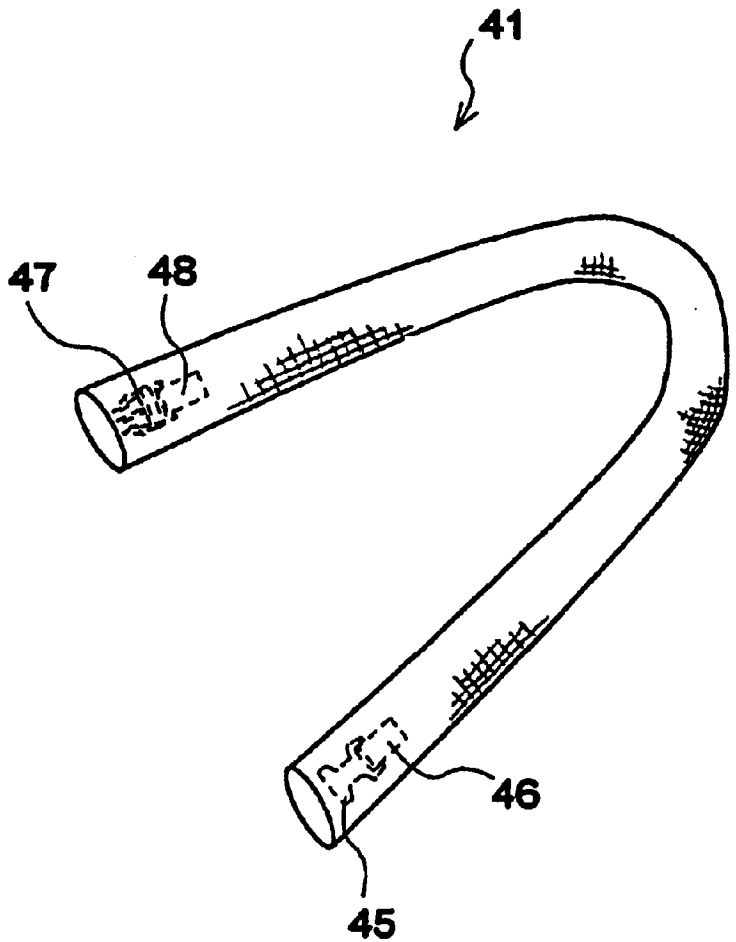
FIG. 8 shows appearance of an adapter 41.

Moreover, the position to provide the fastener 21 is not limited to a certain position, it may be provided to the rim (a boundary between the side surface and the bottom) of the bottom part 3*a* so as to open the rim in order to insert the PET bottle 2 from the bottom. In that case, it is required that the size of the opening is at least a size so as to expose the neck of the bottle 2. In that case, size of the opening may be formed in a size so that at least the forefront of the PET bottle 2 to be exposed therefrom The lengths of the left arm 5, and the right arm 7 are adjusted so that the forefronts of the arms are just in contact with the bottom 3*a* in the embodiment described above, the lengths may be longer or shorter than that. Alternatively, the lengths of the arms, when the left arm 5 and the right arm 7 are connected each other, may be adjusted using an adapter 41 illustrated in FIG. 8. A male piece 47 is provided to one end of the adapter 41 via a rubber strip 48 similar to the left arm 5, and a female piece 45 is attached to the other end of the adapter 41 via a rubber strip 46 similar to the right arm 7 so that the pieces are housed within the adapter. In order to use such an adapter, both the male piece of the adapter 41 and the female piece of the right arm 7 are adapted so as to be in a locked-state, and both the female piece of the adapter 41 and the male piece of the left arm 5 are adapted so as to be in a locked-state.

Alternatively, two of the adapters 41, one adapter 41 is connected to the left arm 5 and the other adapter 41 is adapted to the right arm 41, may be provided.

Figure 9A:
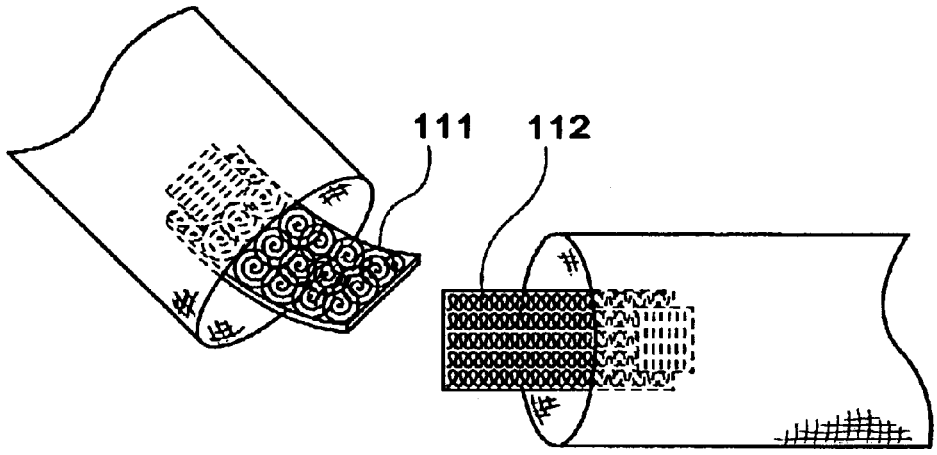
FIGS. 9A, 9B are perspective views illustrating another embodiment of an engaging and holding part.
Figure 9B:
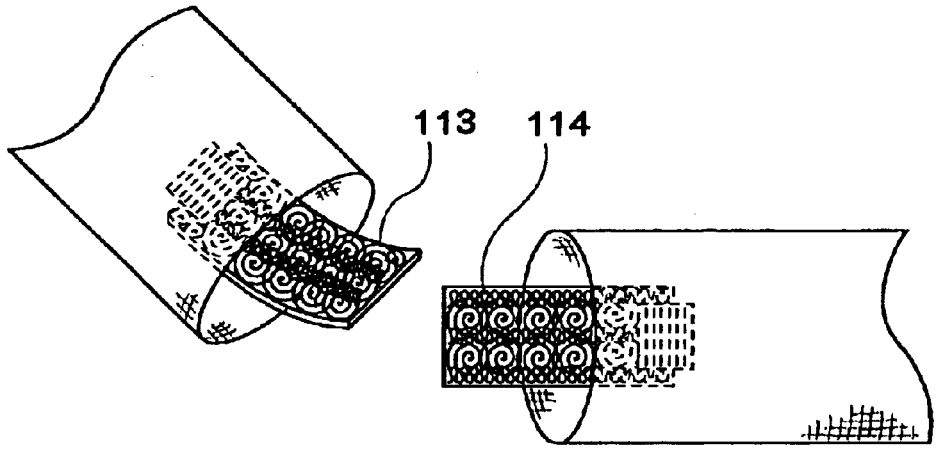
Figure 10A:
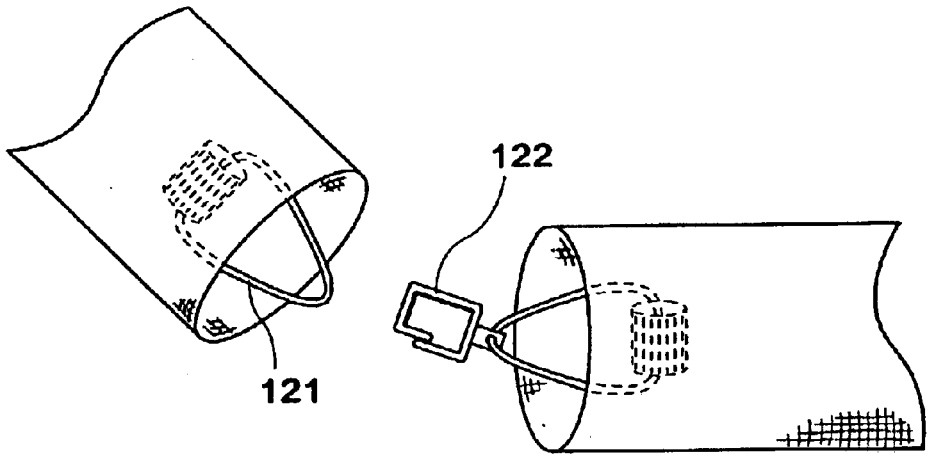
FIGS. 10A, 10B are perspective views illustrating another embodiment of the engaging and holding part.
Figure 10B:
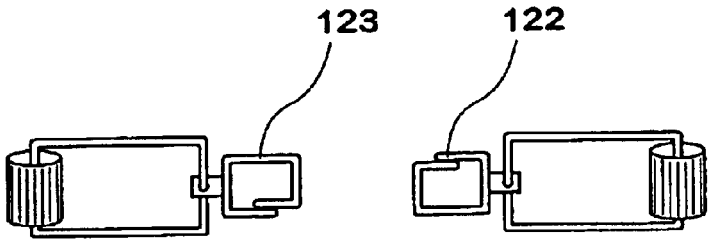
Figure 11:
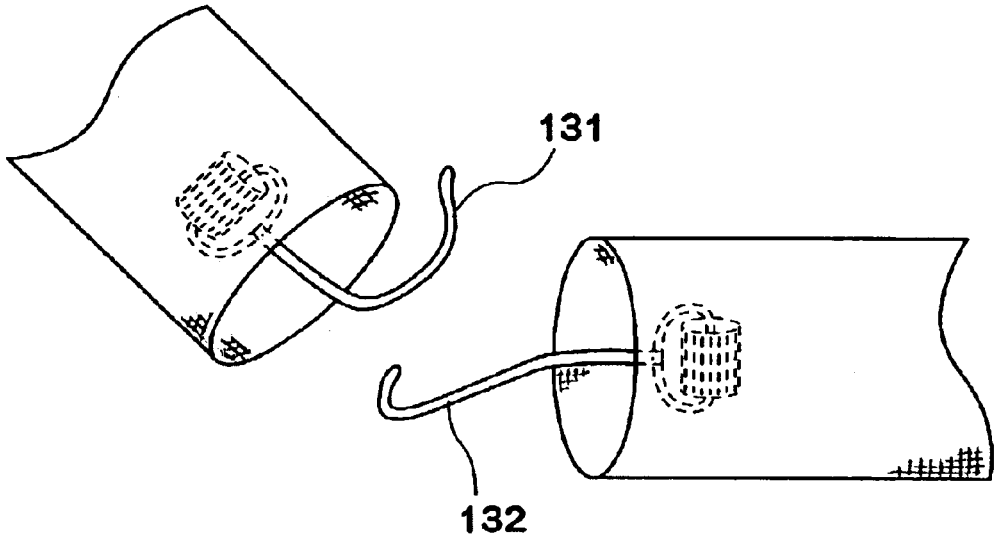
FIG. 11 is a perspective view illustrating another embodiment of the engaging and holding part.
Figure 12:
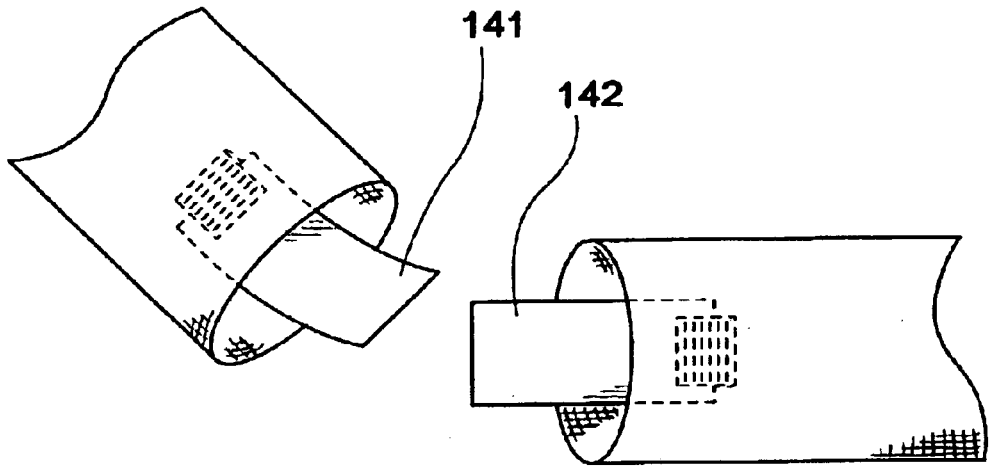
FIG. 12 is a perspective view illustrating another embodiment of the engaging and holding part.
Figure 13:
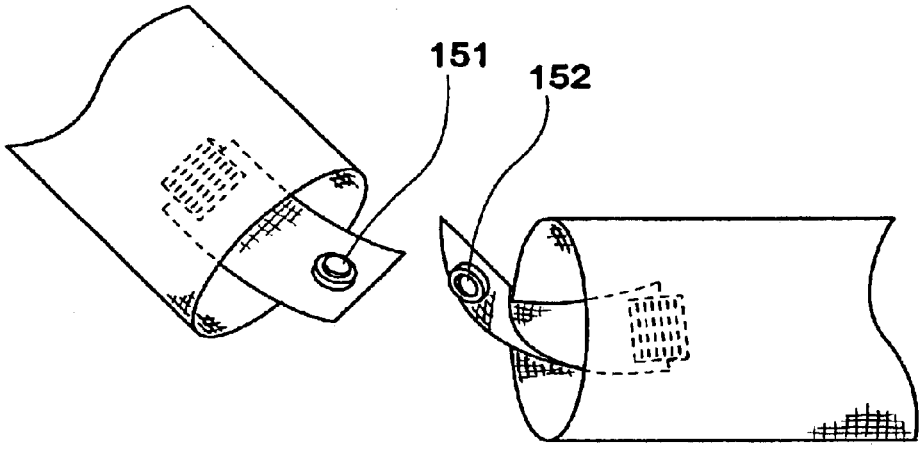
FIG. 13 is a perspective view illustrating another embodiment of the engaging and holding part.
Figure 14:
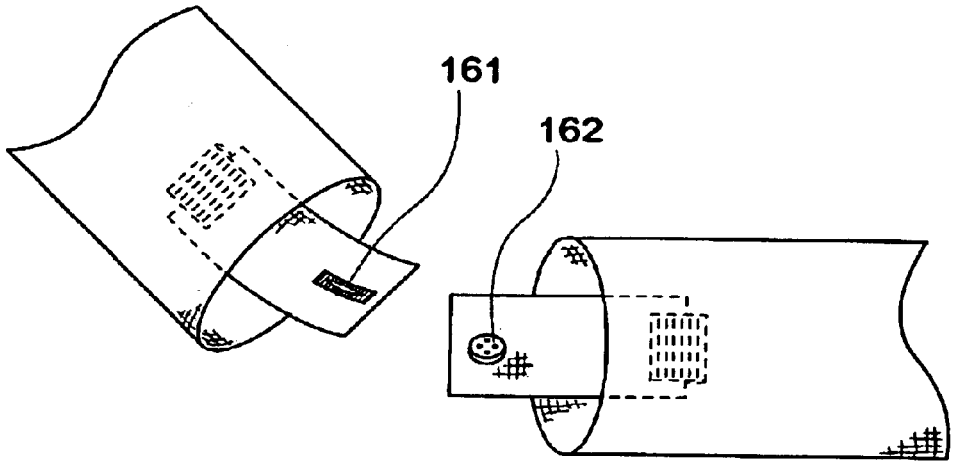
FIG. 14 is a perspective view illustrating another embodiment of the engaging and holding part.
Figure 15:
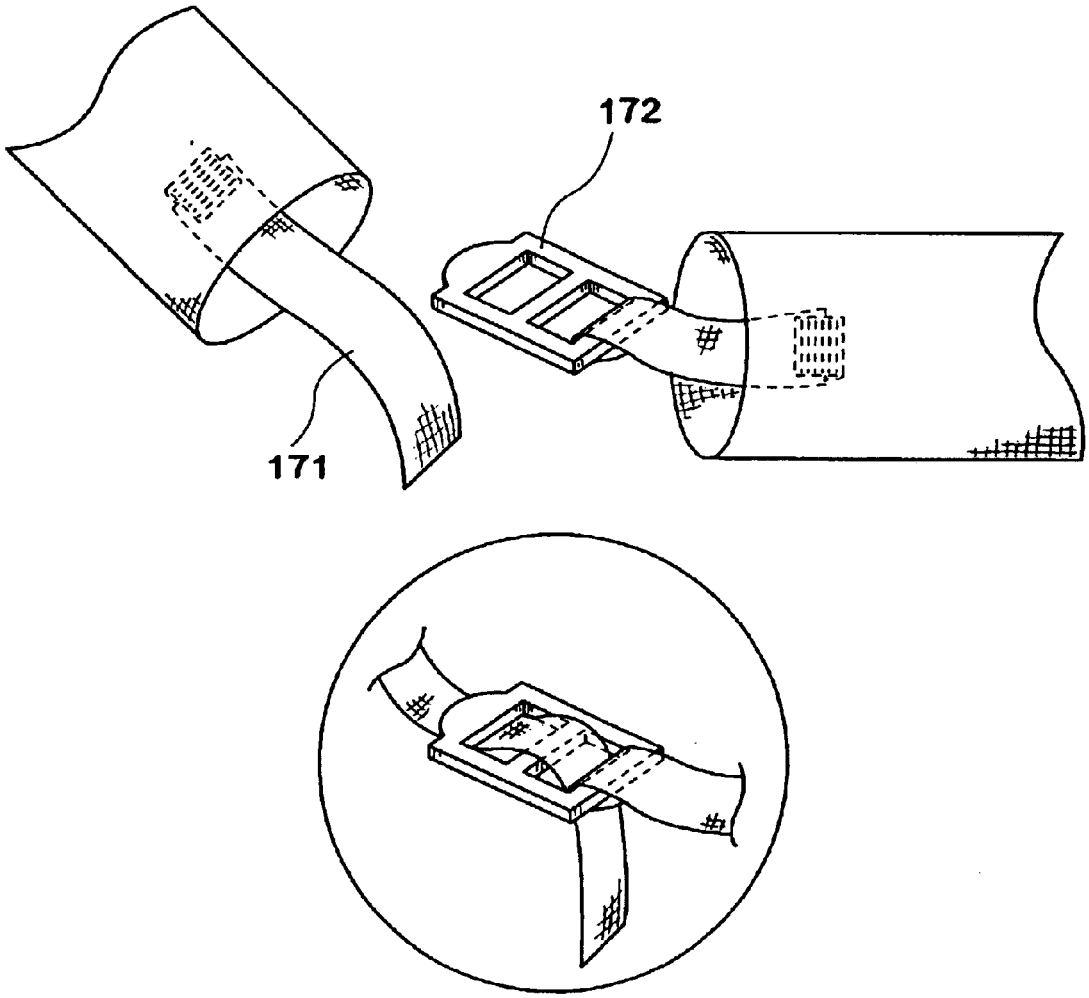
FIG. 15 is a perspective view illustrating another embodiment of the engaging and holding part.
Figure 16:
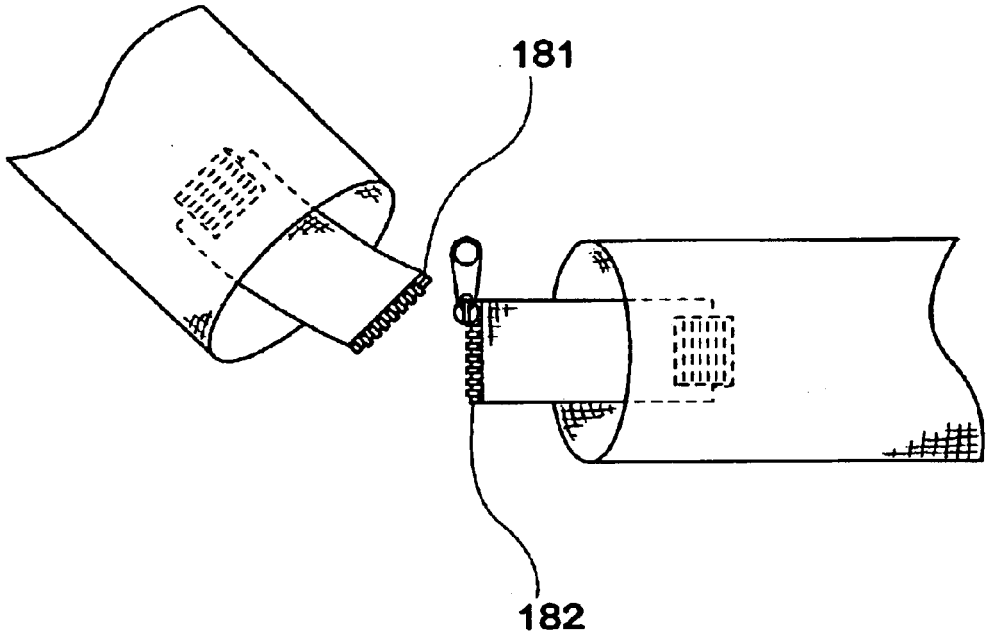
FIG. 16 is a perspective view illustrating another embodiment of the engaging and holding part.
Figure 17:
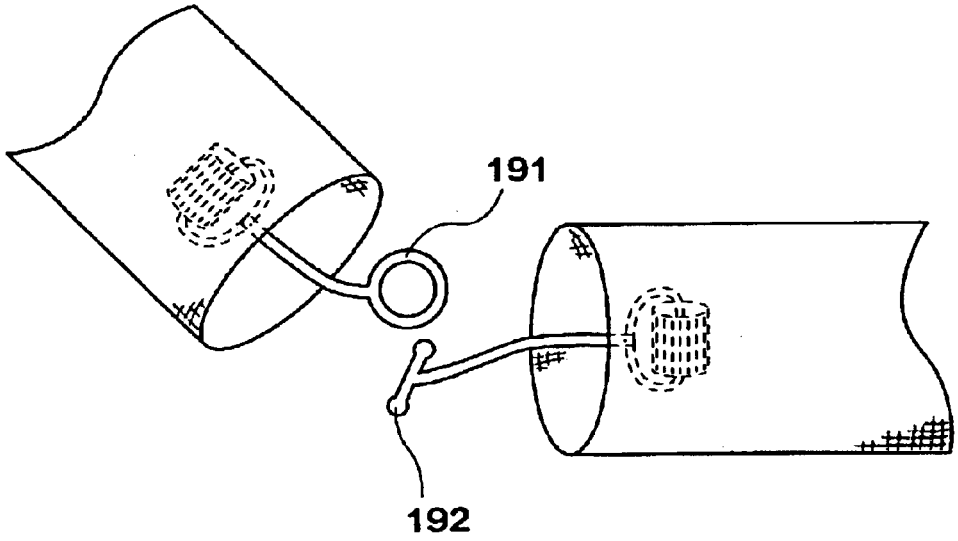
FIG. 17 is a perspective view illustrating another embodiment of the engaging and holding part.
Figure 18:
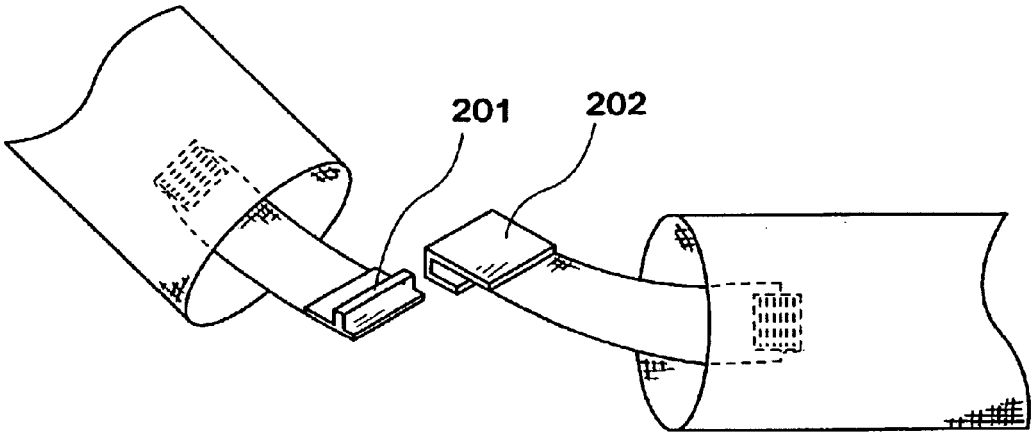
FIG. 18 is a perspective view illustrating another embodiment of the engaging and holding part.
Figure 19:
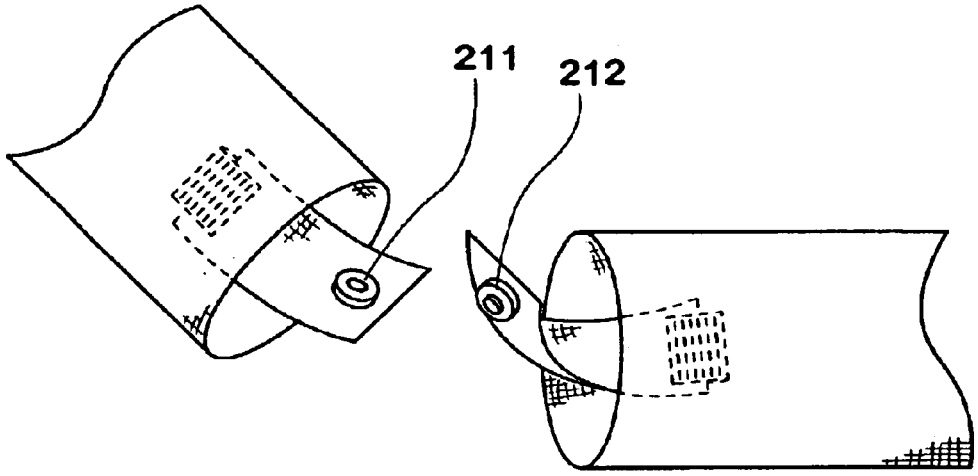
FIG. 19 is a perspective view illustrating another embodiment of the engaging and holding part.
Figure 20:
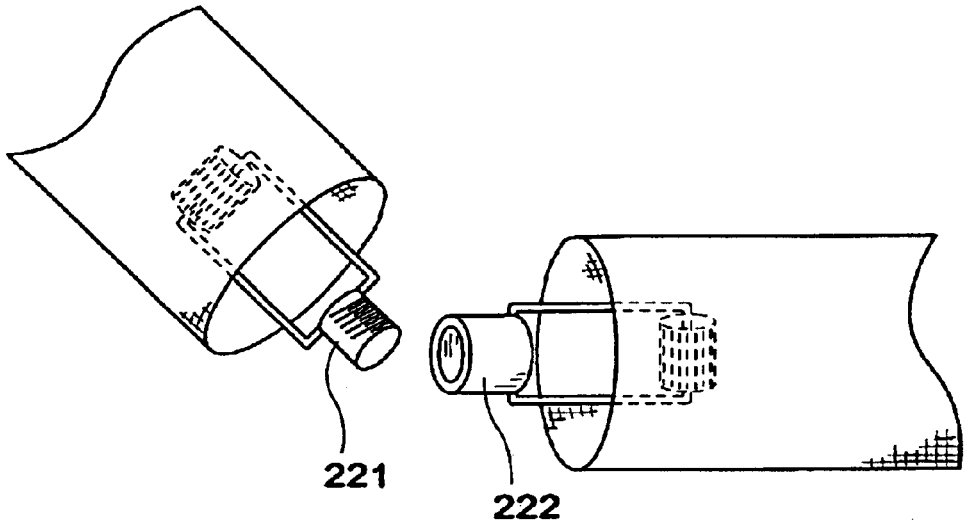
FIG. 20 is a perspective view illustrating another embodiment of the engaging and holding part.
Figure 21A:
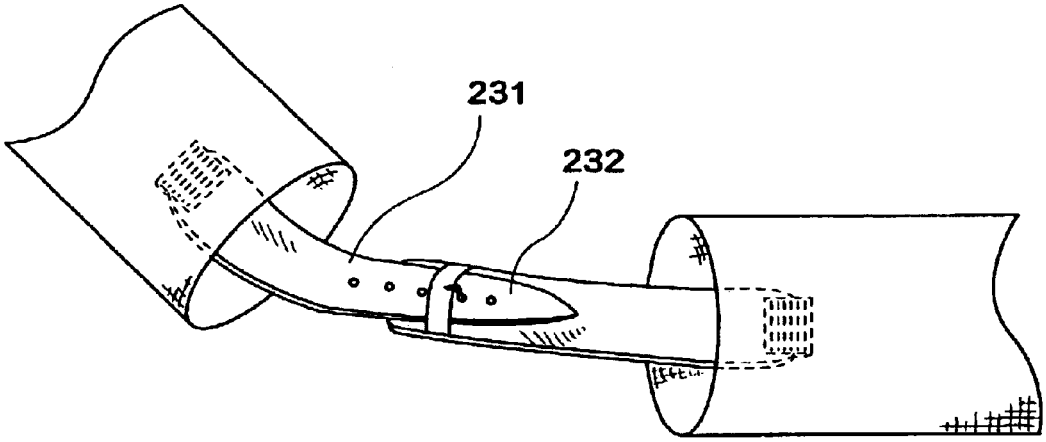
FIGS. 21A, 21B are perspective views illustrating another embodiment of the engaging and holding part.
Figure 21B:
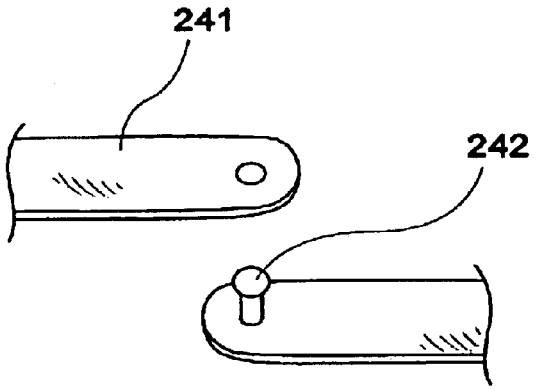
Figure 22:
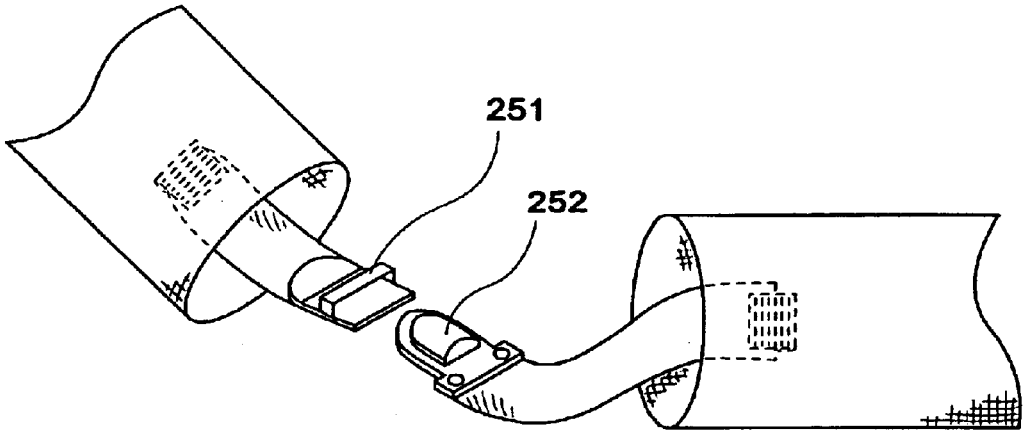
FIG. 22 is a perspective view illustrating another embodiment of the engaging and holding part.

Both the male piece 15 and the female piece 17 are used as an engaging and holding part in the above embodiments, any other structure(s), which can be detachable and can maintain engagement, may be used. Description of such structure(s) will be made with reference to drawings. For example, a female place fastener 111 and a male place fastener 112 shown in FIGS. 9A and 9B may be used. Alternatively, plain fasteners, each can be used as both a male piece and a female piece 113, 114 may be used as shown in FIG. 9B. Alternatively, hooks 121, 122 shown in FIG. 10A may also be used. Instead of the hook 121 unable to open and close, another hook 123, a part of which can be opened and closed as shown in FIG. 10B, may be used. Moreover, strings 131, 132 shown in FIG. 11 may also be used. In addition, adhesive sheets 141, 142 shown in FIG. 12 may further be used. Alternatively a press-stud 151 and a mating press-stud 152 shown in FIG. 13 may be used. Moreover, a buttonhole 161 and a button 162 illustrated in FIG. 14 may also be used. Instead, a string 171 and buckle 172 shown in FIG. 15 may be used. In addition, fastener 181, 182 illustrated in FIG. 16 may also be used. Alternatively, a ring shaped fitting 191, a T-shaped fitting 192 shown in FIG. 17 may further be used. Both the ring shaped fitting 191, the T-shaped fitting 192 shown in FIG. 17 are generally used as an engaging and holding member such as an agraffe for bracelets and the like. These become a locked-state by passing the T-shaped fitting 192 through the ring shaped fitting 191. Instead, a receivable fitting 201 and a hook 202 shown in FIG. 18 may be used. The receivable fitting 201 and the hook 202 shown in FIG. 18 are generally used as an engaging and holding member such as fittings for traditional Japanese socks so called "Tabi". These become a locked-state by hooking the hook 202 into a hole formed in the receivable fitting 201. Alternatively, magnets 211, 212 illustrated in FIG. 19 may be used. Instead, a male thread 221 and a female thread 222 shown in FIG. 20 may also be used. In addition, belt-hole type members 231, 232 illustrated in FIG. 21A may further be used. Alternatively, the adapters can be engaged and held by inserting a convex part 242 having a mushroom shaped forefront into a hole of a sheet member 241 illustrated in FIG. 218. Moreover, a female member 251 formed with retractable button and a male member 252 may further be used as shown in FIG. 22.

Figure 23:
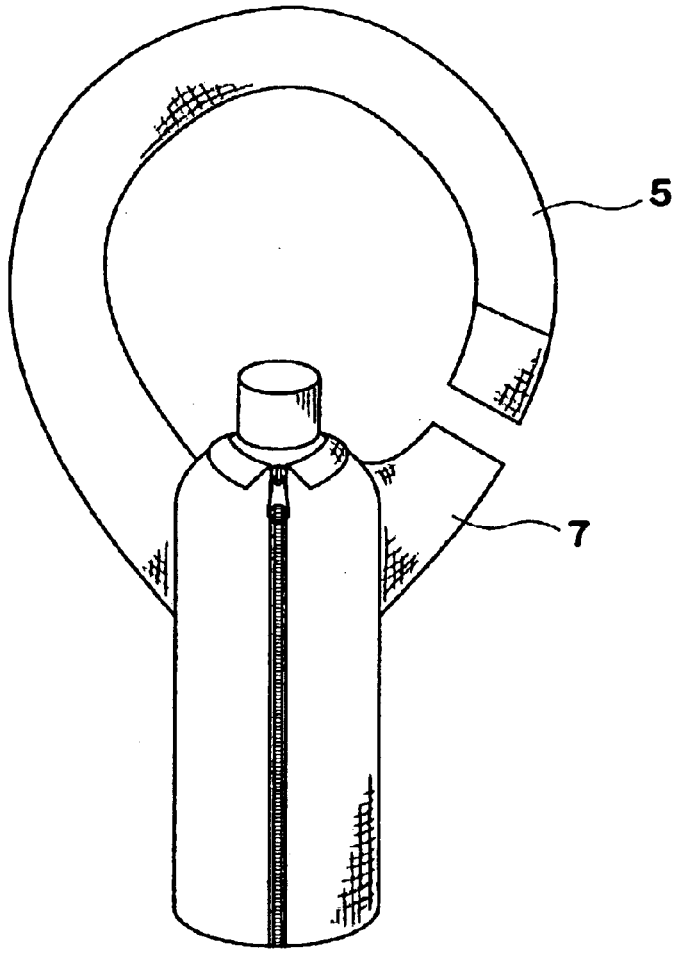
FIG. 23 shows an embodiment in which right arm and left arm have different lengths.

In the embodiments described above, the length of both the left arm 5 and that of the right arm 7 is almost equal with each other, but one may be longer than the other as shown in FIG. 23.

In the embodiment illustrated in FIG. 4, the left arm 5 and the right arm 7 are detachable, both can be undetachable. Because successful outcome still can maintained even in that case.

In the embodiments above described, the body 3 is formed of a heat-retention member, it is not necessary to form the body with heat-retention member.

In the embodiments above described, both the male piece 15 and the female piece 17 are provided so as to completely be accommodated respectively in the left arm 5 and the right arm 7. However, both pieces may be provided so that a part of the forefronts thereof are exposed from arms.

Rubber strips are used as a member capable of being extended, other types of member which can be extended may be used in the embodiments described in the above.

In the embodiments described above, a PET bottle is used as a tubular shaped member, any other content storage case, which can contain food and/or drink (not only liquid but also solid matter such as ice creams) therein as its contents, and capable of eating and drinking once opening a cap, may applicable to the embodiments as well.

Alternatively, any other type of tubular shaped member other than content storage tubular member capable of opening a cap, may applicable to the embodiments. In other words, a content storage case comprises the followings: 1) the content storage case used to cover the content; 2) a body part having one end with a bottom so as to store the content and having the other end being opened; 3) a first arm provided to a side surface of the body adjacent to the other end thereof, the first arm formed in a tubular shape having a smaller diameter than that of the body; 4) a second arm provided opposed to the first arm so as to across the body, and the shape thereof being similar to that of the first arm; 5) a first engaging and holding part provided adjacent to an end of the first arm positioned apart from the body so that the first engaging and holding part is housed inside of the first arm; 6) an engaging and holding part provided as a second engaging and holding part adjacent to an end of the second arm positioned apart from the body so that the first engaging and holding part is housed inside of the second arm and capable of being detached with the first engaging and holding part, wherein; the second engaging and holding part is in a locked-state when it is engaged with the first engaging and holding part; may also applicable to the embodiments.

1) In accordance with characteristics of the present invention, there is provided a tubular-shaped case to be used for covering a tubular member in which content is housed and a cap is provided to an exit and entry part through which the content passes through, the tubular-shaped case comprising: 2) a tubular-shaped body part having one end with a bottom so as to store the content and having the other end being opened; 3) a first arm provided to a side surface of the body adjacent to the other end thereof, the first arm formed in a tubular shape having a smaller diameter than that of the body; 4) a second arm provided opposed to the first arm so as to across the body, and the shape thereof being similar to that of the first arm; 5) a first engaging and holding part provided adjacent to an end of the first arm positioned apart from the body so that the first engaging and holding part is housed inside of the first arm; and 6) an engaging and holding part provided as a second engaging and holding part adjacent to an end of the second arm positioned apart from the body so that the second engaging and holding part is housed inside of the second arm and capable of being detached with the first engaging and holding part, wherein the second engaging and holding part is in a locked-state when the second engaging and holding part is engaged with the first engaging and holding part. Hence, the first and the second arms are formed in a tubular shape, while housing the first and the second engaging and holding parts inside of the first arm and the second arm respectively. In this way, both the first and the second engaging and holding parts are exposed from the first and the second arms and are engaged with the mating parts, then housed inside of arms after their engagement. Consequently, there is no probability to expose both the first and the second engaging and holding parts from the arms, thereby, the first and the second engaging and holding parts do not get in the way during the unengaged state thereof.

2) In accordance with characteristics of the present invention, there is provided a tubular-shaped case, wherein the first engaging and holding part is provided to the first arm via a member capable of being extended, and the second engaging and holding part is provided to the second arm via another member capable of being extended. In this way, the first and the second engaging and holding part can easily be engaged with each other even when the arms are made of a firm material.

3) In accordance with characteristics of the present invention, there is provided a tubular-shaped case, wherein the tubular-shaped body part is made of a heat-retention member. In this way, contents of the tubular member to be held with the tubular-shaped body part can be stored under a heat-retention state.

4) In accordance with characteristics of the present invention, there is provided a tubular-shaped case, wherein the tubular-shaped body part is formed in a shape having a longer length than its width, and the length of the first and the second arm is adjusted so that the forefronts of the arms are just in contact with a surface where the bottom of the body is placed on. In this way, a ring having a similar length to the tubular-shaped body part can be formed when the first and the second engaging and holding parts are engaged with each other 5) In accordance with characteristics of the present invention, there is provided a tubular-shaped case, wherein the first engaging and holding part and the second engaging and holding part provided adjacent to the ends of the first arm and the second arm are completely housed within the arms. In this way, the first engaging and holding part and the second engaging and holding part never get in the way.

6) In accordance with characteristics of the present invention, there is provided a tubular-shaped case, wherein part of the first engaging and holding part and the second engaging and holding part provided adjacent to the ends of the first arm and the second arm are housed within arms. In this way, the first engaging and holding part and the second engaging and holding parts substantially do not get in the way.

7) In accordance with characteristics of the present invention, there is provided a tubular-shaped case, wherein a fastener connected to the other end of the body and capable of enlarging the opening is provided to a side surface of the body. In this way, insertion of the tubular-shaped case can be carried out easily by unzipping the fastener.

8) In accordance with characteristics of the present invention, there is provided a tubular-shaped case, wherein a pocket accommodating a cap for the tubular member is provided on a side of the body. In this way, the cap can be held with the pocket when the cap is removed.

9) In accordance with characteristics of the present invention, there is provided a tubular-shaped case, wherein a hood part that covers the exit and entry part is provided adjacent to the other end of the body. In this way, adherence of contaminants to the bottle can be prevented by covering a portion adjacent to the cap with the hood even when the cap is removed.

10) In accordance with characteristics of the present invention, there is provided a tubular-shaped case, wherein a string is housed around the rim of the hood part and the hood part is in a drawstring-bag state by pulling the string. In this way, the bottle can be held more tightly.

11) In accordance with characteristics of the present invention, there is provided a tubular-shaped case, further comprising: an extendable arm, the shape thereof is similar to that of the first arm wherein the first engaging and holding part and the second engaging and holding part are respectively provided to one end of the extendable arm and the other end thereof via members capable of being extended so as to both the engaging and holding parts be housed in the first and the second arms. In this way, a much longer ring can be formed when the first engaging and holding part and the second engaging and holding part are engaged each other.

12) In accordance with characteristics of the present invention, there is provided a method of suspending content filled in a PET bottle while maintaining temperature of the content, comprising the steps of: 1) storing the PET bottle in a tubular-shaped body part having one end with a bottom and having the other end being opened; 2) providing a first arm formed in a tubular shape having a smaller diameter than that of the body to a side surface of the body adjacent to the other end thereof; 3) setting a first engaging and holding part adjacent to an end of the arm via a member capable of being extended so that the first engaging and holding part is housed inside of the first arm; 4) providing a second arm provided opposed to the first arm so as to across the body, and the shape thereof being similar to that of the first arm; 5) setting an engaging and holding part adjacent to an end of the second arm via a member capable of being extended as a second engaging and holding part so that the engaging and holding part is housed inside of the second arm and capable of being detached with the first engaging and holding part, wherein the second engaging and holding part is in a locked-state when the second engaging and holding part is engaged with the first engaging and holding part; and 6) making the PET bottle capable of being suspended by engaging the first engaging and holding part with the second engaging and holding part. In this way, the suspended state can be released by releasing engagement of the engaging and holding parts. When the engaging and holding parts are engaged, these can easily be exposed form the first and the second arms and can be housed again within the arm after the engagement thereof. Consequently, there is no probability to expose both the first and the second engaging and holding parts from the arms, thereby, the first and the second engaging and holding parts do not get in the way during the unengaged state thereof.

13) In accordance with characteristics of the present invention, there is provided 1) a PET bottle holder for holding a PET bottle, the PET bottle holder comprising: 2) a tubular-shaped body part having one end with a bottom so that the PET bottle can be stored therein and having the other end being opened; and 3) a hood part provided adjacent to the other end of the body, a string being housed around the rim of the hood part and the hood part is in a drawstring-bag state by pulling the string. In this way, a portion adjacent to the cap can be covered with the hood by making it in the Drawstring-bag State under the condition of covering the PET bottle with the hood. Consequently, adhesion of contaminants and the like on around the tap of the bottle can be avoided even when the PET bottle holder is suspended to a bag, for example. In addition, the lost of the cap can likelihood be avoided by making the hood in the drawstring-bag state as a result of accommodating just the cap therein.

14) In accordance with characteristics of the present invention, there is provided 1) a tubular-shaped case to be used for covering a tubular member in which content is housed and a cap is provided to an exit and entry part through which the content passes through, the tubular-shaped case comprising: 2) a tubular-shaped body part having one end with a bottom so as to store the content and having the other end being opened; and 3) a hood part that covers the exit and entry part being provided adjacent to the other end of the body. In this way, a portion adjacent to the cap can be covered with the hood by covering over the PET bottle. Consequently, adherence of contaminants, for example, to the exit and entry part of the bottle can be prevented. Moreover, the cap of the PET bottle can be accommodated.

15) In accordance with characteristics of the present invention, there is provided a tubular-shaped case, wherein a string is housed around the rim of the hood part and the hood part is in a drawstring-bag state by pulling the string. In this way, adherence of contaminants, for example, to the exit and entry part of the bottle can be prevented. Consequently, the lost of the cap can likelihood be avoided by making the hood in the Drawstring-bag State as a result of accommodating just the cap therein.

In the embodiments described above, the tubular case, the first arm, the second arm, the body formed in a tubular shape, the first engaging and holding part, the second engaging and holding part, the member capable of being extended and the extendable arm correspond respectively to the PET bottle holder 1, the left arm 5, the right arm 7, the body 3, the male piece 15, the female piece 17, rubber strips 16, 18 and adapter 41.

The tubular case represents a concept including a circular tube and an angular tube (including a polygonal tube). The phrase such as heat-retention includes both cold storage under which storage is carried out in a lower temperature than ambient temperatures and hot storage under which storage is carried out in a higher temperature than ambient temperatures. Moreover, the body part having one end with a bottom represents a concept including a case, wherein the body has a bottom, which completely covers the one end without any doubt, and a case wherein the tubular member can be held even when a hole(s) exists on a part of the one end.

While the embodiments of the present invention, as disclosed herein, constitute preferred forms, it is to be understood that each term was used as illustrative and not restrictive, and can be changed within the scope of the claims without departing from the scope and spirit of the invention.

What is claimed is:

1. A tubular-shaped case to be used for covering a tubular member in which content is housed and a cap is provided to an exit and entry part through which the content passes through, the tubular-shaped case comprising:

a tubular-shaped body part having one end with a bottom so as to store the content and having the other aid being opened;

a first arm provided to a side surface of the body adjacent to the other end thereof, the first arm formed in a tubular shape having a smaller diameter than that of the body;

a second arm provided opposed to the first arm so as to across the body, and the shape thereof being similar to that of the first arm;

a first engaging and holding part provided adjacent to an end of the first arm positioned apart from the body so that the first engaging and holding part is housed inside of the first arm; and an engaging and holding put provided as a second engaging and holding part adjacent to an end of the second arm positioned apart from the body so that the first engaging and holding part is housed inside of the second arm and capable of being detached with the first engaging and holding part, wherein the second engaging and holding part is in a locked-state when the second engaging and holding part is engaged with the first engaging and holding part.

2. The tubular-shaped case of claim 1, wherein the first engaging and holding part is provided to the first arm via a member capable of being extended, and the second engaging and holding part is provided to the second arm via another member capable of being extended.

3. The tubular-shaped case of claim 1, wherein the tubular-shaped body part is made of a heat-retention member.

4. The tubular-shaped case of claim 1, wherein the tubular-shaped body part is formed in a shape having a longer length than its width, and the length of the first and the second arm is adjusted so that the forefronts of the arms are just in contact with a surface where the bottom of the body is placed on.

5. The tubular-shaped case of claim 1, wherein the first engaging and holding part and the second engaging and holding part provided adjacent to the ends of the first arm and the second arm are completely housed within the arms.

6. The tubular-shaped case of claim 1, wherein part of the first engaging and holding part and the second engaging and holding part provided adjacent to the ends of the first arm and the second arm are housed within arms.

7. The tubular-shaped case of claim 1, wherein a fastener connected to the other end of the body and capable of enlarging the opening is provided to a side surface of the body.

8. The tubular-shaped case of claim 1, wherein a pocket accommodating a cap for the tubular member is provided on a side of the body.

9. The tubular-shaped case of claim 1, wherein a hood part that covers the exit and entry part is provided adjacent to the other end of the body.

10. The tubular-shaped case of claim 9, wherein a string is housed around the rim of the hood part and the hood part is in a drawstring-bag state by pulling the string.

11. The tubular-shaped case of claim 1, further comprising:

an extendable arm, the shape thereof is similar to the first arm wherein the first engaging and holding part and the second engaging and holding part are respectively provided to one end of the extendable arm and the other end thereof via members capable of being extended so as to both the engaging and holding parts be housed in the first and the second arms.

12. A content storage case used to cover the content comprising:

a body part having one end with a bottom so as to store the content and having the other end being opened;

a first arm provided to aside surface of the body adjacent to the other end thereof, the first arm formed in a tubular shape having a smaller diameter than that of the body;

a second arm provided opposed to the first arm so as to across the body, and the shape thereof being similar to that of the first arm;

a first engaging and holding part provided adjacent to an end of the first arm positioned apart from the body so that the first engaging and holding part is housed inside of the first arm; and an engaging and holding part provided as a second engaging and holding part adjacent to an end of the second arm positioned apart from the body adjacent to an end of the second arm positioned apart from the body so that the first engaging and holding part is housed inside of the second arm and capable of being detached with the first engaging and holding part, wherein; the second engaging and holding part is in a locked-state when it is engaged with the first engaging and holding part.

13. A method of suspending content filled in a PET bottle while maintaining temperature of the content, comprising the steps of:

storing the PET bottle in a tubular-shaped body part having one end with a bottom and having the other end being opened;

providing a first arm formed in a tubular shape having a smaller diameter than that of the body to a side surface of the body adjacent to the other end thereof;

setting a first engaging and holding part adjacent to an end of the arm via a member capable of being extended so that the first engaging and holding part is housed inside of the first arm;

providing a second arm provided opposed to the first arm so as to across the body, and the shape thereof being similar to that of the first arm;

setting an engaging and holding part adjacent to an end of the second arm via a member capable of being extended as a second engaging and holding part so that the engaging and holding part is housed inside of the second arm and capable of being detached with the first engaging and holding part, wherein the second engaging and holding part is in a locked-state when the second engaging and holding part is engaged with the first engaging and holding part; and making the PET bottle capable of being suspended by engaging the first engaging and holding part with the second engaging and holding part.

* * * * *